US010869797B2

(12) United States Patent
Ringbjer et al.

(10) Patent No.: US 10,869,797 B2
(45) Date of Patent: Dec. 22, 2020

(54) SUBJECT SUPPORT SLINGS INCLUDING VISUAL INDICATORS FOR COUPLING TO LIFT MECHANISMS

(71) Applicant: Liko Research & Development AB, Luleå (SE)

(72) Inventors: Catherine Ringbjer, Luleå (SE); Anders Eriksson, Luleå (SE); Johanna Sundqvist, Gammelstad (SE); Asa Lundstrom, Luleå (SE)

(73) Assignee: LIKO RESEARH & DEVELOPMENT AB, Lulea (SE)

( * ) Notice: Subject to any disclaimer, the term of this patent is extended or adjusted under 35 U.S.C. 154(b) by 260 days.

(21) Appl. No.: 15/850,353

(22) Filed: Dec. 21, 2017

(65) Prior Publication Data

US 2018/0207042 A1 Jul. 26, 2018

Related U.S. Application Data

(60) Provisional application No. 62/450,679, filed on Jan. 26, 2017.

(51) Int. Cl.
*A61G 7/10* (2006.01)

(52) U.S. Cl.
CPC ..... *A61G 7/1051* (2013.01); *A61G 7/1042* (2013.01); *A61G 7/1055* (2013.01); *A61G 7/1063* (2013.01); *A61G 7/1078* (2013.01); *A61G 7/1015* (2013.01); *A61G 2203/16* (2013.01); *A61G 2205/20* (2013.01)

(58) Field of Classification Search
CPC .. A61G 7/1051; A61G 7/1055; A61G 7/1063; A61G 7/1042; A61G 7/1078; A61G 2205/20; A61G 2203/16; A61G 7/1015
USPC ..... 5/85.1
See application file for complete search history.

(56) References Cited

U.S. PATENT DOCUMENTS 3,905,055 A * 9/1975 Blair ..... A61G 7/1015 5/85.1
5,054,140 A * 10/1991 Bingham ..... A61G 7/001 5/600
5,253,657 A * 10/1993 Butterfield ..... A61G 7/1023 128/845

(Continued)

FOREIGN PATENT DOCUMENTS

WO WO-2015042293 A2 * 3/2015 ..... A61G 1/003

OTHER PUBLICATIONS

Liko, "Solo RepoSheet™ Generous", 7EN161108 Rev. 2, pp. 1-4.

(Continued)

*Primary Examiner* — Nicholas F Polito
*Assistant Examiner* — Luke Hall
(74) *Attorney, Agent, or Firm* — Dinsmore & Shohl LLP

(57) ABSTRACT

A subject support system includes a sling, a clamp, and a strap coupled to the clamp. The sling includes an outer perimeter extending around and defining a support region of the sling and a visual indicator positioned along the outer perimeter of the sling. The clamp is selectively coupled to the visual indicator. The clamp is repositionable between a closed position, in which the clamp is engaged with the visual indicator, and an open position, in which the clamp is disengaged from the visual indicator. The strap coupled to the clap is configured to couple the clamp to a lift mechanism.

17 Claims, 7 Drawing Sheets

(56) References Cited

U.S. PATENT DOCUMENTS 5,737,781 A * 4/1998 Votel ..... A61G 7/1015 24/265 EC
6,175,973 B1 * 1/2001 Hakamiun ..... A61G 7/1017 5/86.1
6,219,862 B1 * 4/2001 Horcher ..... A61G 7/1017 5/81.1 R
6,289,534 B1 * 9/2001 Hakamiun ..... A61G 7/1017 5/83.1
6,341,393 B1 * 1/2002 Votel ..... A61G 7/1015 5/484
6,658,676 B1 * 12/2003 Persson ..... A61G 7/1026 5/81.1 HS
7,168,110 B2 * 1/2007 Girard ..... A61G 1/01 5/627
7,458,113 B2 * 12/2008 Milam ..... A61G 7/1026 254/329
8,281,430 B1 * 10/2012 Hough ..... A61G 7/1051 5/625
8,936,253 B1 * 1/2015 Rizzi ..... A61G 1/013 280/17
9,173,798 B2 * 11/2015 Hillenbrand, II .... A61G 7/1026
9,192,535 B2 * 11/2015 Sverdlik ..... A61G 7/1026
2002/0104535 A1 * 8/2002 Biondo ..... A61H 9/0078 128/204.21
2002/0166168 A1 * 11/2002 Weedling ..... A61G 7/103 5/81.1 R
2006/0037136 A1 * 2/2006 Weedling ..... G09F 3/00 5/81.1 HS
2006/0137097 A1 * 6/2006 Frost ..... A61G 7/1051 5/628
2007/0220671 A1 * 9/2007 Vanderheiden ..... A61G 7/001 5/81.1 R
2008/0301873 A1 * 12/2008 White ..... A61G 7/001 5/85.1
2010/0043141 A1 * 2/2010 Short ..... A61G 7/1015 5/89.1
2011/0126351 A1 * 6/2011 Walker ..... A61G 7/1015 5/87.1
2011/0219538 A1 * 9/2011 McWattie ..... A61G 7/1051 5/87.1
2012/0216345 A1 * 8/2012 Hand ..... A61G 7/103 5/85.1
2012/0240332 A1 * 9/2012 Palay ..... A61G 7/1051 5/83.1
2013/0000040 A1 * 1/2013 Conley ..... A61G 5/006 5/604
2013/0042409 A1 * 2/2013 Gil Gomez ..... A61G 7/1028 5/487
2013/0152950 A1 * 6/2013 Giap ..... A61G 7/1023 128/872
2013/0269103 A1 * 10/2013 Van Oirschot ..... A61G 7/1011 5/83.1
2014/0082843 A1 * 3/2014 Papadakos ..... A47C 23/34 5/618
2015/0047121 A1 * 2/2015 Berg ..... A61G 7/1051 5/83.1
2015/0074903 A1 3/2015 Berg et al.
2015/0216753 A1 * 8/2015 Arespong ..... A61G 7/1013 5/83.1
2015/0342811 A1 * 12/2015 Wong ..... A61G 7/1063 5/81.1 T
2016/0095777 A1 * 4/2016 Berman ..... A61G 7/1051 5/81.1 T
2017/0056267 A1 * 3/2017 Stryker ..... A61G 7/1046

OTHER PUBLICATIONS

Liko, "RepoSheet™ Original", 7EN160156 Rev. 7, pp. 1-6.
Liko, HandySheet™, Model 150, 160, 7EN160196-03, Oct. 2008, pp. 1-4.
Liko, HandyTube™, Model 100, 110, 120, 7EN160188-02, Oct. 2008, pp. 1-6.

* cited by examiner

SUBJECT SUPPORT SLINGS INCLUDING VISUAL INDICATORS FOR COUPLING TO LIFT MECHANISMS

CROSS REFERENCE RELATED APPLICATIONS

The present specification claims the benefit of U.S. Provisional Patent Application Ser. No. 62/450,679 filed Jan. 26, 2017 and entitled "Subject Support Slings Including Visual Indicators For Coupling to Lift Mechanisms," the entirety of which is incorporated by reference herein.

BACKGROUND

Field

The present specification generally relates to subject support slings, and more particularly to subject support slings including visual indicators for coupling the slings to lift mechanisms.

Technical Background

Person lifting devices, such as mobile lifts and/or overhead lifts, may be used in hospitals, other health care facilities, and sometimes in home care settings to move a subject or assist in moving a subject from one location to another. Conventional lifting devices are coupled to a subject support sling that supports and engages the subject. Such conventional support slings may include a variety of straps and loops that must be coupled in a specific way to a lift mechanism in order to properly lift the subject. However, the coupling of the straps and loops are not always intuitive for a caregiver.

Accordingly, a need exists for alternative subject support slings that simplify the coupling of the sling to a lift mechanism.

SUMMARY

In one embodiment, a subject support system includes a sling, a clamp, and a strap coupled to the clamp. The sling includes an outer perimeter extending around and defining a support region of the sling and a visual indicator positioned along the outer perimeter of the sling. The clamp is selectively coupled to the visual indicator. The clamp is repositionable between a closed position, in which the clamp is engaged with the visual indicator, and an open position, in which the clamp is disengaged from the visual indicator. The strap coupled to the clap is configured to couple the clamp to a lift mechanism.

In another embodiment, a subject support sling includes a sling, a first pair of clamps, a second pair of clamps, and a plurality of straps coupled to one of the clamps and configured to couple the clamps to a lift mechanism. The sling includes an outer perimeter extending around and defining a subject support surface of the sling. The sling has a first end and a second end positioned opposite the first end. The first pair of clamps is each selectively coupled to the first end of the sling along the outer perimeter of the sling. The second pair of clamps is each selectively coupled to the second end of the sling along the outer perimeter of the sling.

According to various embodiments, a method of lifting a subject includes positioning a sling between the subject and a surface upon which the subject is disposed. The sling includes an outer perimeter extending around and defining a support region of the sling and a visual indicator along the outer perimeter of the sling. The method also includes engaging a clamp with the visual indicator to selectively couple the clamp to the visual indicator. The clamp is coupled to a strap configured to couple the clamp to a lift mechanism. The method further includes activating the lift mechanism to lift the subject.

Additional features of subject support apparatuses described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
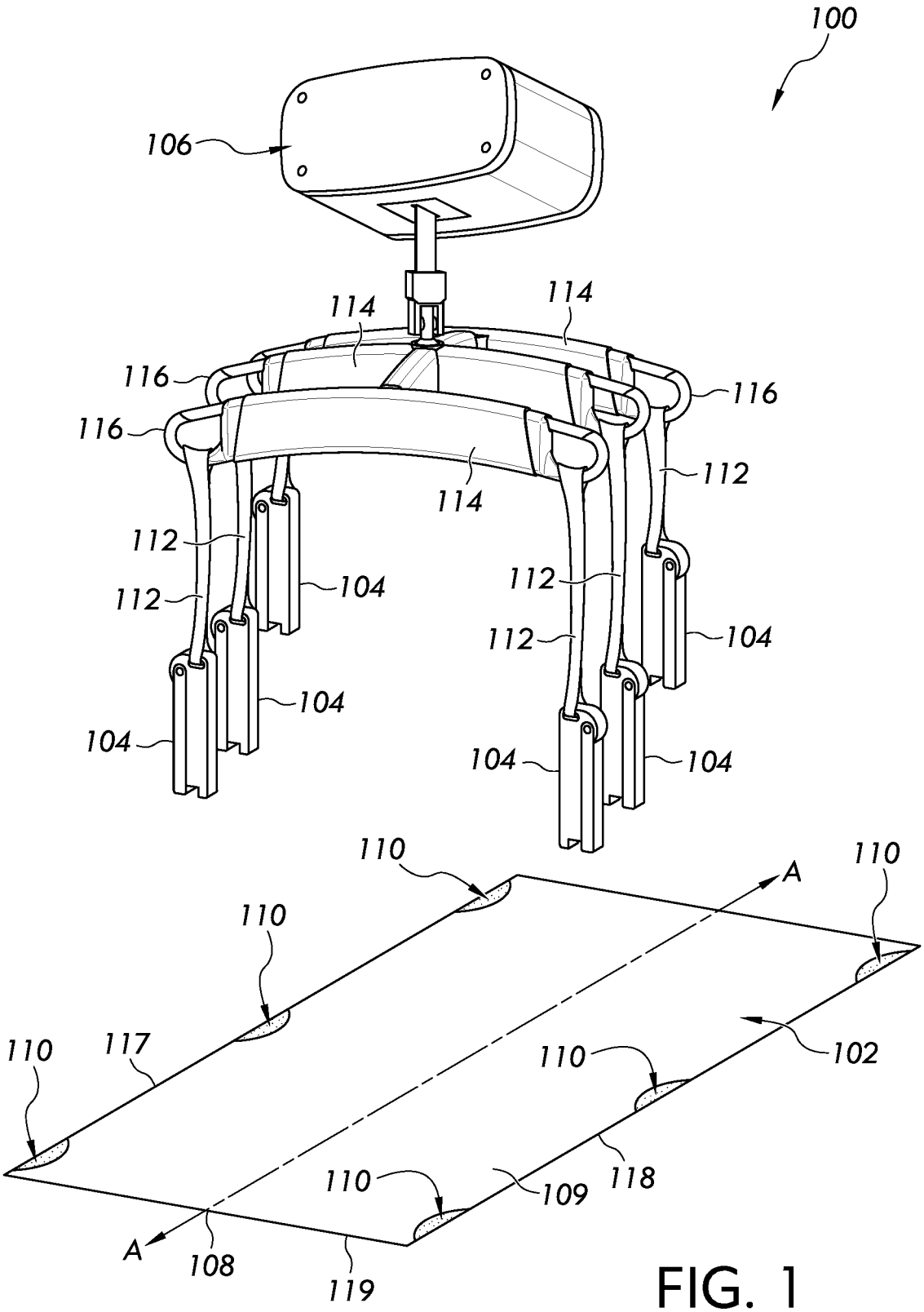
FIG. 1 schematically depicts a subject support system according to one or more embodiments shown and described herein.

Reference will now be made in detail to embodiments of subject support systems, examples of which are illustrated in the accompanying drawings. Whenever possible, the same reference numerals will be used throughout the drawings to refer to the same or like parts. In one embodiment, a subject support system includes a sling that includes at least one visual indicator and a clamp that may be selectively coupled to the visual indicator to couple the sling to a lift mechanism. Without being bound by theory, the visual indicator may enable a caregiver to easily identify a position along the outer perimeter of the sling at which the clamp should be coupled for lifting the subject. Various embodiments of subject support systems will be described herein with specific reference to the appended drawings.

Subject Support Slings

Referring to FIG. 1, a subject support system 100 includes a subject support sling 102, clamps 104, and a lift mechanism 106. The sling 102 includes a plurality of visual indicators 110 that are positioned along an outer perimeter 108 of the sling 102. The clamps 104 may be selectively coupled to the visual indicators 110 to couple the sling 102 to the lift mechanism 106. More particularly, the clamps 104 may be coupled to the lift mechanism 106 by straps 112 selectively coupled to a sling bar assembly 114 which is, in turn, connected to the lift mechanism 106, as will be described in greater detail below.

The sling 102 is in the form of a sheet having an outer perimeter 108 that extends around and defines a support region 109 of the sling 102. In some embodiments, such as the embodiment shown in FIG. 1, the sling 102 is substantially planar (e.g., flat), although in other embodiments, the sling 102 may be constructed with contours in multiple dimensions, such as contours which correspond to the human body. For example, the sling 102 may include darts or other structural features that enable the sling to conform to the contours of a subject's body. The sling 102 may be formed from any suitable material. In various embodiments, the sling 102 may be a single, substantially continuous piece of flexible material, such as a sheet of pliable material selected from nylon, a cotton polyester blend, or polyester. In some embodiments, the material may be a mesh or other breathable material that enables air flow between the sling 102 and the subject supported by the sling 102. Other materials are contemplated, provided that they have sufficient strength to support the weight of the subject during lifting. In some embodiments, the material may be selected based on a recommended weight range for use of the sling 102. For example, a sling for use with a lower recommended weight range (e.g., for a child or small adult) may be made from a material that has a lower strength as compared to a sling for use with a higher recommended weight range (e.g., adult bariatric patients). Moreover, in some embodiments, the material may be selected to make the sling 102 washable and reusable, or, alternatively, disposable.

In some embodiments, the sling 102 may have a coating on one or more surfaces of the material. For example, the sling 102 may include a coating to make the surface of the material wipeable, water-resistant, or antimicrobial. Additionally or alternatively, the sling 102 may include a coating to make a surface of the material have low friction, such as to aid in sliding the sling 102 between the subject and the subject support surface.

In various embodiments, the sling 102 is free of straps sewn to the sling 102 and/or loops for coupling the sling 102 to a lift mechanism 106. The absence of straps and/or loops may simplify construction of the sling 102 while reducing manufacturing costs and enhancing comfort for the subject when the sling 102 is positioned between the subject and a subject support surface. Accordingly, the sling 102 may remain disposed between the subject and the subject support surface when not in use for lifting the subject without adversely impacting the comfort of the subject. Moreover, because the sling 102 of various embodiments may be in the form of a sheet without straps or loops, the sling 102 may be stored, transported, or supplied to a consumer on a roll or simply folded upon itself.

The sling 102 depicted in FIG. 1 includes six visual indicators 110 located along the outer perimeter 108 of the sling 102. However, various embodiments may include a greater or fewer number of visual indicators 110. For example, the sling 102 may include one pair (e.g., two) visual indicators, two pairs of visual indicators, three pairs of visual indicators, four pairs of visual indicators, or the like. Additionally, in some embodiments, visual indicators may be included that are not part of one or more pairs of visual indicators. For example, a sling 102 may include three, five, seven, or nine visual indicators, depending on the particular embodiment.

Figure 2:
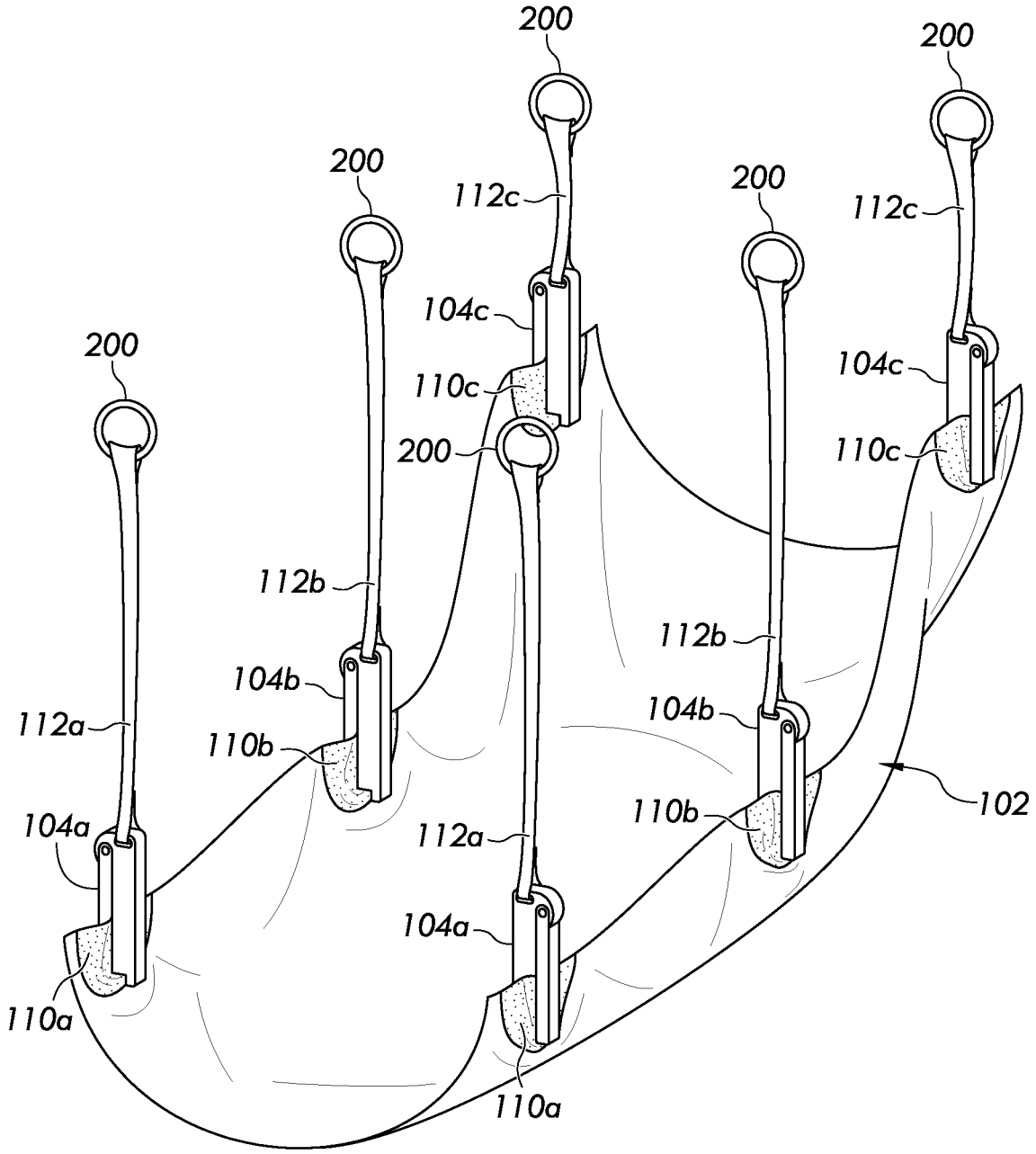
FIG. 2 schematically depicts a subject support sling in a first example configuration according to one or more embodiments shown and described herein.
Figure 3:
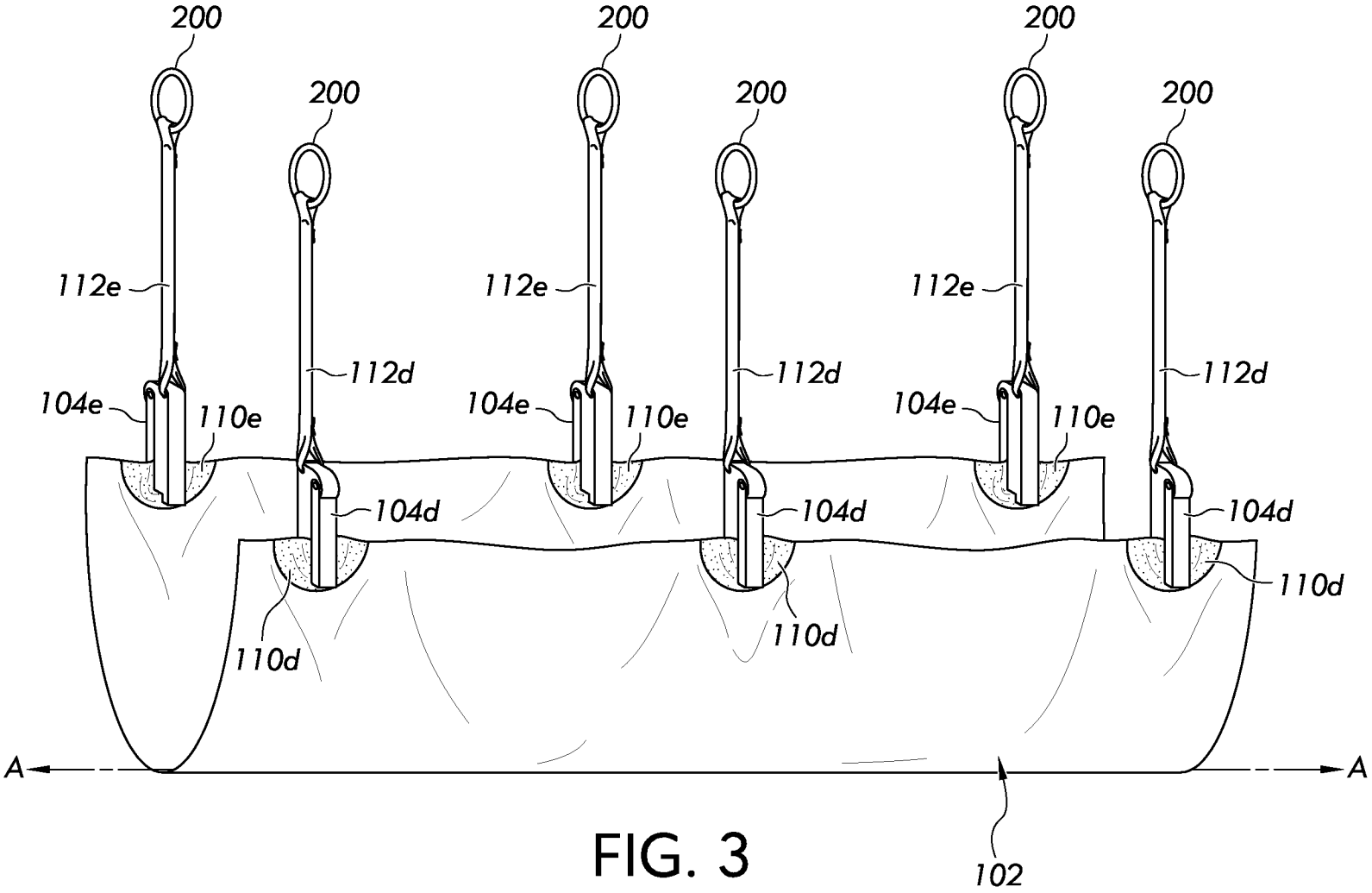
FIG. 3 schematically depicts a subject support sling in a second example configuration according to one or more embodiments shown and described herein.

In the embodiment in FIG. 1, each pair of visual indicators 110 includes a first visual indicator along a first edge 117 of the sling 102 and a second, corresponding, visual indicator along a second, opposing edge 118 of the sling 102. In other words, the visual indicators 110 are positioned symmetrically about a longitudinal axis A-A. However, it is contemplated that in some embodiments, visual indicators 110 may be located elsewhere on the outer perimeter 108 of the sling 102, such as along an edge 119 bisected by the longitudinal axis A-A. In still other embodiments, pairs or groups of visual indicators may be positioned along the same side of the sling 102, as will be discussed with regard to FIG. 3. In various embodiments, the particular location of each of the visual indicators 110 may be determined based at least in part on a type of lift to be performed with the sling 102. For example, the visual indicators 110 may be in a first set of locations on a sling used for lifting a subject in a sitting position (as depicted in FIG. 2), while the visual indicators 110 may be in a second set of locations on a sling used for lifting a subject in a horizontal position (as depicted in FIG. 3).

The visual indicators 110 may be made of the same material as the sling 102, or a different type of material. In embodiments, the visual indicators 110 may be integral with the sling 102, or the visual indicators 110 may be patches or separate pieces of material attached to the sling 102. Accordingly, in some embodiments, the visual indicators 110 may be made of the same material, but have a different visual effect, as the material making up the support region 109 of the sling 102. In one particular example, the visual indicators 110 may all have the same color as one another, but a different color than the support region 109 of the sling 102. In another example, each pair of visual indicators 110 may have a different color than the other pair(s) of visual indicators 110, each color of the pairs of visual indicators 110 being different than the color of the support region 109 of the sling 102. In yet another example, each visual indicator 110 may have a different color than other visual indicators 110 and the support region 109 of the sling 102.

In other embodiments, the visual indicators 110 may be made of a different type of material than the sling 102. For example, the sling 102 may be made of a nylon, a cotton polyester blend, or a polyester, while the visual indicators 110 may be made of vinyl, suede, a different weight of nylon or polyester, or another type of material. In some embodiments, the visual indicators 110 may have a different feel than the remaining portions of the sling 102. For example, the visual indicators 110 may be made of a material or include a coating that increases friction to enhance the grip of the clamps 104 on the visual indicators 110.

Other types of visual effects for the visual indicators are additionally contemplated. For example, the visual indicators 110 may have a pattern, texture, marking, or other indicia thereon to enable a user to visually identify the appropriate location for coupling the clamps 104 to the sling 102. Accordingly, as used herein, the term "visual effect"

includes color, pattern, texture, marking, or other indicia that would be visibly and/or tactilely perceptible to a user.

Still referring to FIG. 1, each of the clamps 104 is repositionable between a closed position, in which the clamp may be engaged with the visual indicator 110 of the sling 102 (depicted in FIGS. 4A and 5A), and an open position, in which the clamp 104 is disengaged from the visual indicator 110 of the sling 102, as depicted in FIG. 1. Accordingly, each of the clamps 104 may be selectively coupled to the visual indicators 110. The clamps 104 may be made of any suitable type of material, such as a plastic, composite, metal, or combinations thereof. The clamps 104 will be described in further detail herein with specific reference to FIGS. 4A, 4B, 5A, and 5B.

As shown in FIG. 1, each of the clamps 104 is coupled to a strap 112. The straps 112 are configured to couple the clamps 104 to the lift mechanism 106. In the embodiment depicted in FIG. 1, the straps 112 are coupled to a sling bar assembly 114 using hooks 116 on the end of each elongated bar of the sling bar assembly 114, as will be described in greater detail below.

Figure 4A:
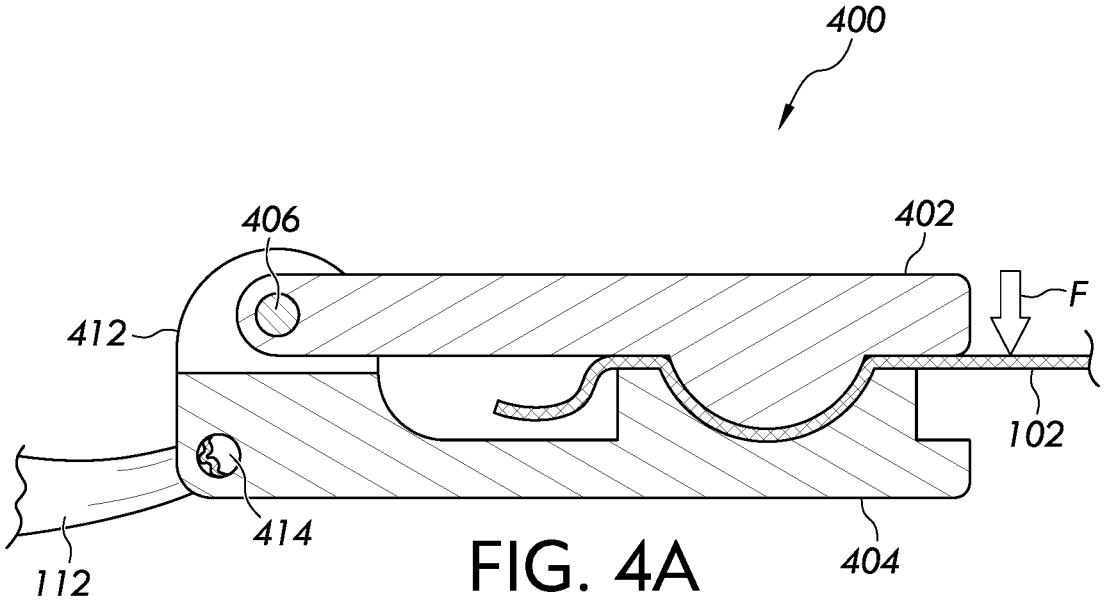
FIG. 4A schematically depicts an example clamp in a closed position according to one or more embodiments shown and described herein.
Figure 4B:
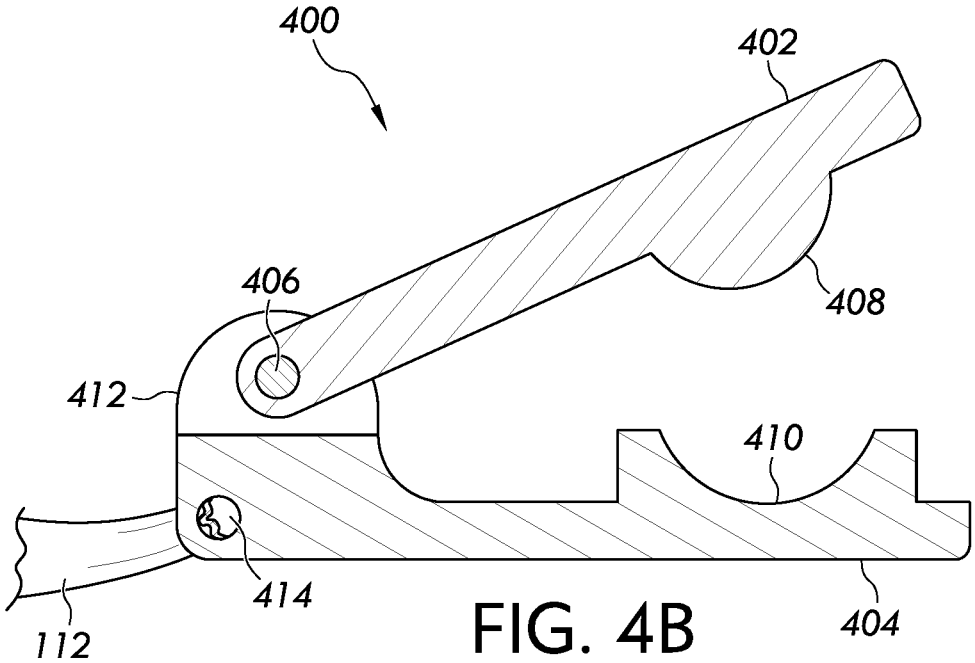
FIG. 4B schematically depicts the example clamp of FIG. 4A in an open position according to one or more embodiment shown and described herein.
Figure 5A:
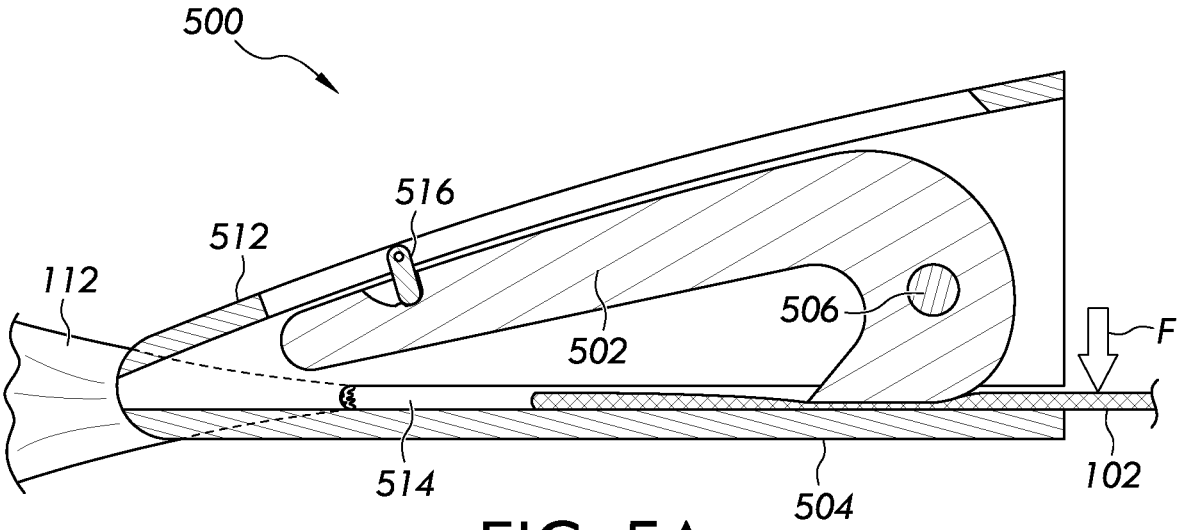
FIG. 5A schematically depicts another example clamp in a closed position according to one or more embodiments shown and described herein.
Figure 5B:
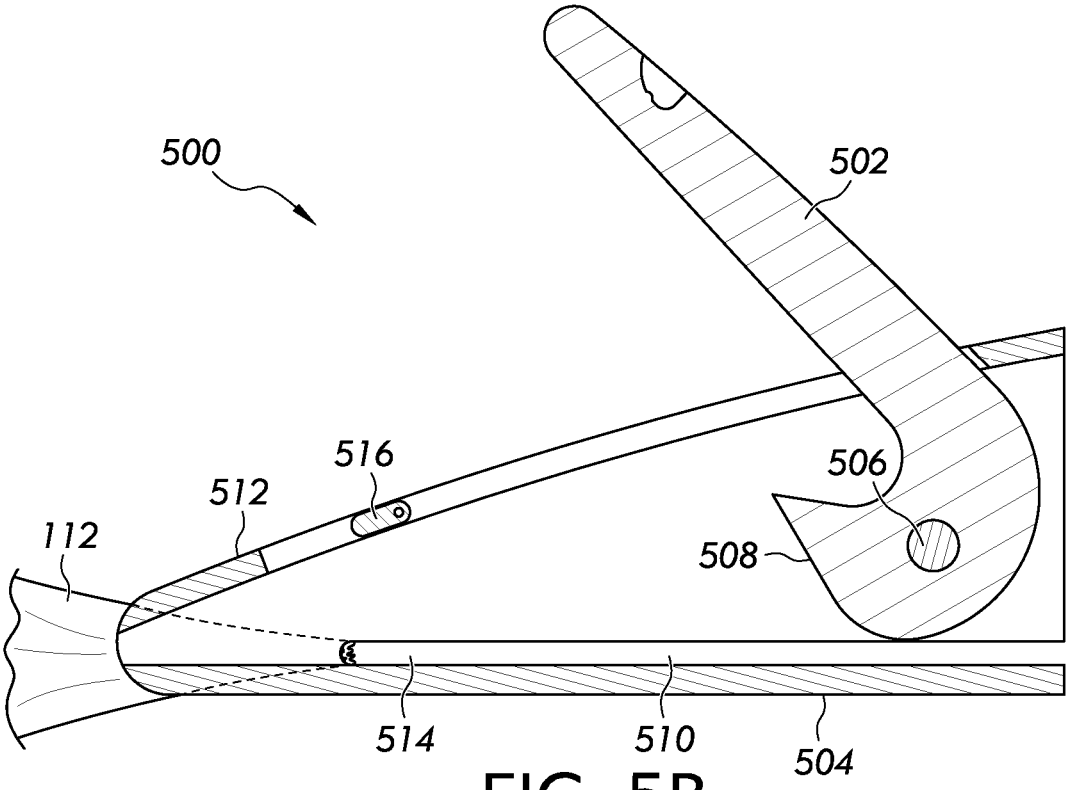
FIG. 5B schematically depicts the example clamp of FIG. 5A in an open position according to one or more embodiments shown and described herein.

The straps 112 may be coupled to the clamps 104 in a variety of ways. For example, a strap 112 may be threaded through a hole formed proximate one end of the clamp 104, as depicted in FIGS. 1, 4A, and 4B. Alternatively, the strap 112 may be coupled to the clamp 104 using a ring, or may be looped or tied around the end of the clamp 104, as depicted in FIGS. 5A and 5B.

Moreover, the straps 112 may include a ring or loop at an end opposing the end coupled to the clamp 104 to enable the strap 112 to be coupled to the sling bar assembly 114. For example, in the embodiment depicted in FIG. 1, the straps 112 are coupled to the sling bar assembly 114 using loops formed at the end of the straps 112. In particular, a length of the strap 112 may be folded back on itself and stitched to form a loop at the end of the strap 112, which may then be engaged with the hooks 116 on the end of each elongated bar of the sling bar assembly 114. As another example, in the embodiments depicted in FIGS. 2 and 3, each strap 112 includes a ring 200 at the end which may be used to engage the hooks 116 on the end of each elongated bar of the sling bar assembly 114.

The straps 112 may be formed from any suitable material, provided they have sufficient strength to support the weight of the subject. For example, in various embodiments, the straps 112 may be formed from a woven nylon strap, such as a strap formed from ballistic nylon.

Having described the subject support system 100 generally, additional details regarding the sling 102 will now be described with specific reference to FIGS. 2 and 3.

FIG. 2 schematically depicts a subject support sling 102 coupled to a plurality of clamps 104*a*, 104*b*, 104*c* in a first example configuration. In FIG. 2, each of the plurality of clamps 104*a*, 104*b*, 104*c* is depicted in a closed position and engaged with a visual indicator 110*a*, 110*b*, 110*c* of the sling 102. In particular, a first pair of clamps 104*a* is engaged with a first pair of visual indicators 110*a* near a first end of the sling 102, a second pair of clamps 104*b* is engaged with a second pair of visual indicators 110*b* near a central portion of the sling 102, and a third pair of clamps 104*c* is engaged with a third pair of visual indicators 110*c* near a second end of the sling 102 opposing the first end of the sling 102.

In various embodiments, the first pair of visual indicators 110*a* may have a first visual effect (e.g., a color, pattern, texture, marking, or other indicia), the second pair of visual indicators 110*b* may have a second visual effect, and the third pair of visual indicators 110*c* may have a third visual effect. In embodiments, the first visual effect differs from the second visual effect and the third visual effect, and the second visual effect differs from the third visual effect. Accordingly, each pair of visual indicators has a visual effect that differs from some or all of the other pairs of visual indicators.

Moreover, in various embodiments, each of the pairs of clamps 104*a*, 104*b*, 104*c*, includes a visual effect that corresponds to the visual effect of the corresponding visual indicators 110*a*, 110*b*, 110*c*. For example, the first pair of clamps 104*a* may have a visual effect that matches the visual effect of the first pair of visual indicators 110*a*, such as a portion that includes the same color as the visual indicators 110*a*. Accordingly, in addition to identifying a location for engaging the clamp, the visual indicators may further indicate which clamp is to be engaged. This may, for example, indicate to a caregiver or other user, which clamp is to be engaged at each location on the sling 102 to achieve the desired configuration.

In the embodiment depicted in FIG. 2, the straps 112*a*, 112*b*, 112*c* are connected at one end to a corresponding clamp 104*a*, 104*b*, 104*c*, and to a ring 200 at a second end. As described hereinabove, the ring 200 may be used to couple the straps 112*a*, 112*b*, 112*c* to a sling bar assembly 114 in order to lift the subject.

Additionally, as depicted in FIG. 2, the straps 112*a*, 112*b*, 112*c* have various lengths that enable the support system to achieve the configuration depicted. For example, the straps 112*a* and 112*b* are longer in length than the straps 112*c* to enable the support system to form a sitting position. Accordingly, in various embodiments, it is contemplated that a first group of straps may have a length that is different than a length of a second group of straps. However, in other embodiments, such as the embodiment depicted in FIG. 3, the straps may all have a substantially similar length.

Referring now to FIG. 3, a subject support sling 102 coupled to a plurality of clamps 104*d*, 104*e* in a second example configuration is schematically depicted. In FIG. 3, each of the plurality of clamps 104*d*, 104*e* is depicted in a closed position and engaged with a visual indicator 110*d*, 110*e*, of the sling 102. In particular, a first group of clamps 104*d* is engaged with a first group of visual indicators 110*d* along a first longitudinal side of the sling 102, and a second group of clamps 104*e* (two of which are not shown in the view depicted in FIG. 3) is engaged with a second group of visual indicators 110*e* along a second longitudinal side of the sling 102 opposing the first longitudinal side.

In the embodiment depicted in FIG. 3, the first group of visual indicators 110*d* may have a first visual effect (e.g., a color, pattern, texture, marking, or other indicia) and the second group of visual indicators 110*e* may have a second visual effect. In embodiments, the first visual effect differs from the second visual effect. Accordingly, each group of visual indicators has a visual effect that differs from some or all of the other groups of visual indicators. For example, a first visual effect may correspond to a "right" side of the sling 102 while a second visual effect may correspond to a "left" side of the sling 102.

As above, each group of clamps 104*d*, 104*e*, includes a visual effect that corresponds to the visual effect of the corresponding visual indicators 110*d*, 110*e*. For example, the first group of clamps 104*d* may have a visual effect that matches the visual effect of the first group of visual indicators 110*d*, such as a portion that includes the same color as the visual indicators 110*d*.

In the embodiment depicted in FIG. 3, each of the straps 112*d*, 112*e* has substantially the same length as the other straps. Accordingly, when the straps 112*d*, 112*e* are coupled to a sling bar assembly 114 using the rings 200, the support system may lift the subject in a horizontal position, and the sling 102 may fold about the longitudinal axis A-A.

Although FIGS. 2 and 3 depict the sling 102 being suitable for use in lifting a subject in a sitting position (FIG. 2) and a horizontal position (FIG. 3), it is contemplated that other configurations may be employed. Additionally, it should be understood that alternative arrangements of the visual indicators 110 are contemplated. For example, more or fewer visual indicators 110 may be employed, and some configurations may include visual indicators 110 along the outer perimeter 108 of the sling 102 other than those depicted in the FIGS.

Referring now to FIGS. 4A and 4B, an example clamp 400 is depicted in a closed position (FIG. 4A) and in an open position (FIG. 4B). In general, the clamp 400 includes a clamp portion 402 and a base portion 404 that is pivotally coupled to the clamp portion 402 through a fulcrum 406. When the clamp 400 is in a closed position, as depicted in FIG. 4A, the clamp 400 may be engaged with the sling 102, and more particularly, the visual indicator 110 of the sling 102.

Referring to FIG. 4B, the clamp 400 includes a clamp portion 402 and a base portion 404. In view of FIG. 4B, a clamping side 408 of the clamp portion 402 faces and opposes a clamping side 410 of the base portion 404. In the embodiment depicted in FIGS. 4A and 4B, the clamping side 408 of the clamp portion 402 and the clamping side 410 of the base portion 404 have complementary configurations such that when the clamp portion 402 and the base portion 404 are pivotally rotated into a closed position, the clamping side 408 of the clamp portion 402 and the clamping side 410 of the base portion 404 are disposed close together to clamp the sling 102 tightly therebetween. In particular, the clamping side 408 of the clamp portion 402, as illustrated in FIG. 4B includes an outwardly projecting, or male, surface while the clamping side 410 of the base portion 404 has a groove, or female, surface that is substantially the inverse of the clamping side 408 of the clamp portion 402 and is fitted to couple to the male surface of the clamping side 408 of the clamp portion 402. Other shapes and configurations for the clamping side 408 of the clamp portion 402 and the clamping side 410 of the base portion 404 are contemplated. In some embodiments, one or both of the clamping sides 408, 410 may have a surface modification, such as a high friction coating, that increases the friction force that may be applied by the one or both of the clamping sides 408, 410 when in contact with the sling 102. Alternatively or additionally, the configuration of the clamping sides 408, 410 may be selected to increase the contact surface area and the friction force between the clamping sides 408, 410 and the sling. For example, the clamping side 408 of the clamp portion 402 and the clamping side 410 of the base portion 404 may have a wavy configuration.

Both the clamp portion 402 and the base portion 404 are made of materials having sufficient thickness and stiffness to apply a force in a direction that is transverse to a plane of the sling 102 (e.g., across the thickness of the sling 102) when the clamp 400 is in the closed position, as represented by the force F in FIG. 4A. For example, the clamp components may be made of a metal, a plastic, a composite, or a combination thereof. Moreover, the clamp portion 402 may be made of the same material as the base portion 404, or the clamp portion 402 may be made of a different material than the base portion 404. In various embodiments, the clamp portion 402 may be maintained in the closed position and engaged with the base portion 404 by a latch or other lock, as will be discussed in greater detail below.

The clamp 400 also includes a visual effect 412 that may correspond to a visual effect of at least one visual indicator 110 on the sling 102. As described in detail above, the visual effect 412 may be, for example, a color, a pattern, a texture, a marking or other indicia, or the like.

FIGS. 4A and 4B further depict the strap 112 being coupled to the clamp 400 using an opening 414 formed in the surface of the clamp 400. Although the opening 414 is depicted as being positioned near an end of the clamp 400, it is contemplated that the opening 414 may positioned at other locations on the clamp 400, such as near a center section of the clamp 400, depending on the particular orientation of the clamp 400. The opening 414 may be punched or drilled in the clamp 400, or may be formed integrally in the surface of the clamp 400, such as when the clamp 400 is molded.

Furthermore, it is contemplated that in some embodiments, the clamp 400 may not include an opening for coupling the clamp 400 to the strap 112. In such embodiments, the strap 112 may be coupled to the clamp 400 by looping the strap 112 around the clamp, as depicted in FIGS. 5A and 5B.

In practice, the visual indicator 110 of the sling 102 may be positioned along the clamping side 410 of the base portion 404 and the clamp portion 402 may be pivotally rotated into a closed position such that the clamping side 408 of the clamp portion 402 is in contact with a surface opposing the surface of the visual indicator 110 positioned along the clamping side 410 of the base portion 404. The clamp portion 402 may be pivotally rotated, for example, by squeezing the clamp portion 402 toward the base portion 404.

Turning now to FIGS. 5A and 5B, another example clamp 500 is depicted in a closed position (FIG. 5A) and in an open position (FIG. 5B). In general, the clamp 500 includes a clamp portion 502 and a base portion 504 that is pivotally coupled to the clamp portion 502 through a fulcrum 506. When the clamp 500 is in a closed position, as depicted in FIG. 5A, is may be engaged with the sling 102, and more particularly, the visual indicator 110 of the sling 102.

Referring to FIG. 5B, the clamp 500 includes a clamp portion 502 and a base portion 504. In view of FIG. 5B, a clamping side 508 of the clamp portion 502 faces and opposes a clamping side 510 of the base portion 504 when the clamp 500 is in the closed position (FIG. 5A). In the embodiment depicted in FIGS. 5A and 5B, the clamping side 508 of the clamp portion 502 and the clamping side 510 of the base portion 504 have complementary configurations such that when the clamp portion 502 and the base portion 504 are in a closed position, the clamping side 508 of the clamp portion 502 and the clamping side 510 of the base portion 504 are disposed close together to clamp the sling 102 tightly therebetween. In some embodiments, one or both of the clamping sides 508, 510 may have a surface modification, such as a high friction coating, that increases the friction force that may be applied by the one or both of the clamping sides 508, 510 when it is in contact with the sling 102. In the embodiment depicted in FIGS. 5A and 5B, the clamping side 508 of the clamp portion 502 is disposed on a cam part of the clamp portion 502. When the clamp portion 502 is rotated about the fulcrum 506, the cam part is brought into close proximity with the clamping side 510 of the base portion 504 such that the sling 102 is impinged between the clamping side 508 of the clamp portion 502 on the cam part and the clamping side 510 of the base portion 504.

As in the previous embodiment, both the clamp portion 502 and the base portion 504 are made of materials having sufficient thickness and stiffness to apply a force in a direction that is transverse to a plane of the sling 102 (e.g., across the thickness of the sling 102) when the clamp 500 is in the closed position, as represented by the force F in FIG. 5A. For example, the clamp components may be made of a metal, a plastic, a composite, or a combination thereof. Moreover, the clamp portion 502 may be made of the same material as the base portion 504, or the clamp portion 502 may be made of a different material than the base portion 504.

The clamp 500 also includes a visual effect 512 that may correspond to a visual effect of at least one visual indicator 110 on the sling 102. As described in detail above, the visual effect 512 may be, for example, a color, a pattern, a texture, a marking or other indicia, or the like.

FIGS. 5A and 5B further depict the strap 112 being coupled to the clamp 500 by looping the strap 112 around the clamp, as depicted in FIGS. 5A and 5B. In particular, the base portion 504 includes a recess 514 configured to receive the sling 102 into which a loop formed by the strap 112 may be positioned to engage the clamp 500.

The clamp 500 in FIGS. 5A and 5B further includes a lock 516 that may be engaged to retain the clamp 500 in the closed position, thereby preventing the clamp 500 from inadvertently being repositioned into the open position and disengaging from the sling 102. The lock 516 may be, for example, a latch or switch positioned to keep the clamp portion 502 and the base portion 504 in position relative to one another.

In practice, the visual indicator 110 of the sling 102 may be positioned along the clamping side 510 of the base portion 504 and the clamp portion 502 may be pivotally rotated into a closed position such that the clamping side 508 of the clamp portion 502 is in contact with a surface opposing the surface of the visual indicator 110 positioned along the clamping side 510 of the base portion 504. The lock 516 may be rotated to prevent the clamp portion 502 from rotating into an open position.

Sling Bar Assemblies

Figure 6:
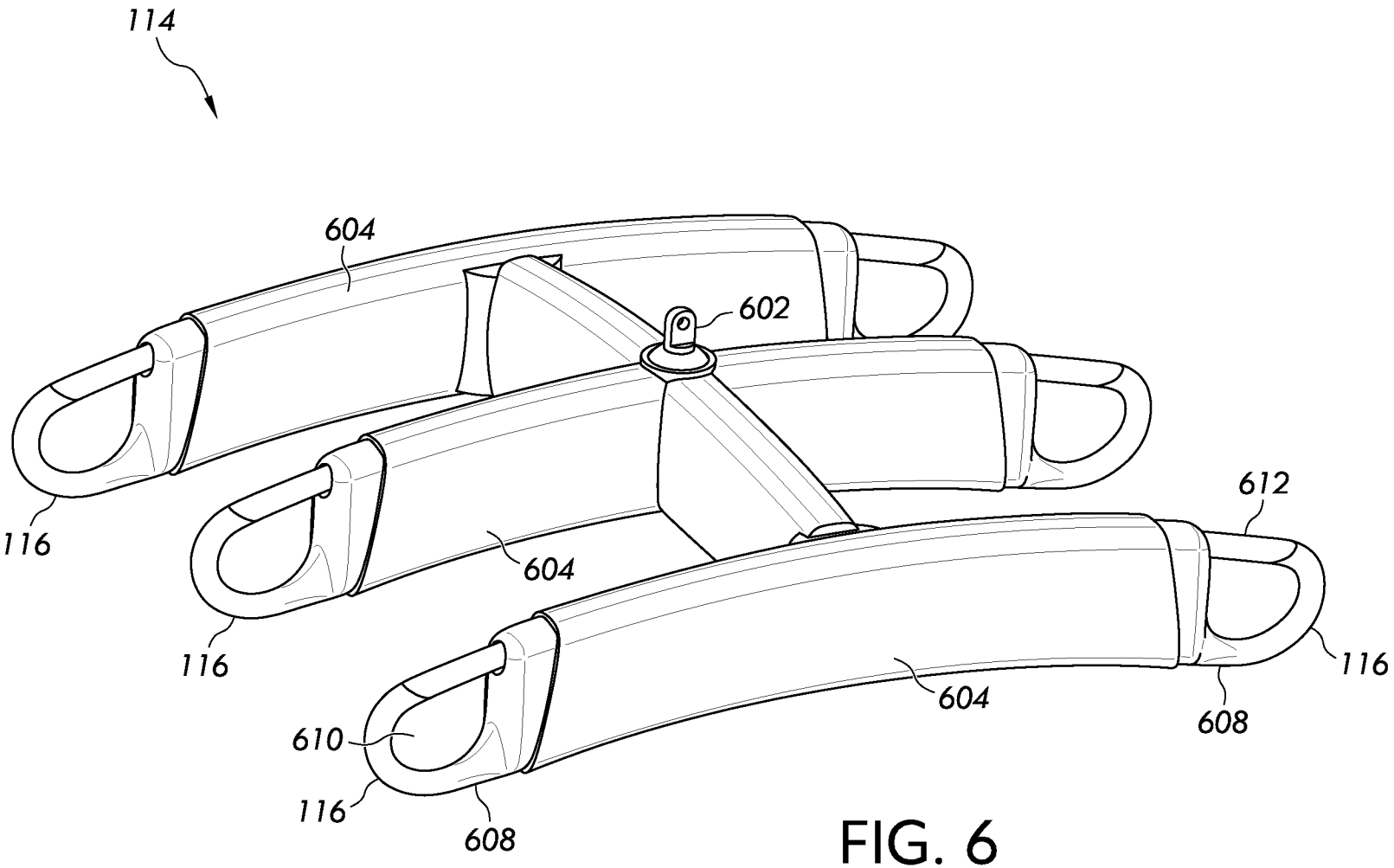
FIG. 6 schematically depicts a sling bar assembly according to one or more embodiments shown and described herein.

In various embodiments, such as the embodiment depicted in FIG. 1, the subject support sling 102 is coupled to a lift mechanism using a sling bar assembly 114. FIG. 6 depicts a sling bar assembly 114 in greater detail.

As shown in FIG. 6, the sling bar assembly 114 includes a connector 602 for coupling the sling bar assembly 114 to a lift mechanism. The connector 602 is fixedly coupled to the sling bar assembly 114 in FIG. 6, although in other embodiments, the connector 602 may be movably coupled to the sling bar assembly 114. Without being bound by theory, allowing the connector 602 to move with respect to the sling bar assembly 114 may help to decrease the torque forces on the connector 602 when a subject support sling is coupled to the sling bar assembly 114, maintain the alignment of the subject support sling, sling bar assembly, and lift mechanism, and prevent twisting of various components.

The sling bar assembly 114 includes a plurality of elongated bars 604 and two hooks 116 coupled to the distal ends of the elongated bars 604. In other embodiments, the sling bar assembly 114 may include curved frame members coupled by a middle frame member and including additional support apparatus coupling mechanisms. In still other embodiments, the sling bar assembly 114 may include a U-shaped frame including two support apparatus coupling mechanisms and a U-shaped handle extending from the frame to provide stability to a subject being lifted. Other sling bar assembly configurations are contemplated. Various sling bar assembly configurations are described in greater detail in U.S. Patent Application Publication No. 2015/0216753, entitled "Person Lift System", which is hereby incorporated by reference in its entirety.

The hooks 116 include a coupling base 608 with a recessed space 610 therein and a latch 612 configured to selectively enclose the recessed space 610. The latch 612 is pivotably coupled to the coupling base 608 and is configured to extend across the recessed space 610 in a closed position and rotate towards the recessed space 610 in an open position. In operation, when a user couples a subject support sling 102 to the hook 116, the user pushes the latch 612 (i.e., rotates the latch 612 toward the recessed space 610), such as with the strap 112 and/or the ring 200 to allow the strap(s) to be inserted into the recessed space 610. When a user removes the subject support sling 102 from the hook 116, the user pushes the latch 612 to rotate the latch 612 toward an open position (i.e., rotates the latch 612 toward the recessed space 610) and allow the strap 112 to be removed from the recessed space 610.

Suitable sling bars include, by way of example and not limitation, those commercially available under the trade names Universal SlingBar, SlingBar Mini, and Sling CrossBar, from Liko, HILL-ROM®, or Hill-Rom Services, Inc. (Batesville, Ind.). Additionally, it is contemplated that some embodiments may not include a sling bar, as will be described in greater detail below.

Lift Mechanisms

Figure 7:
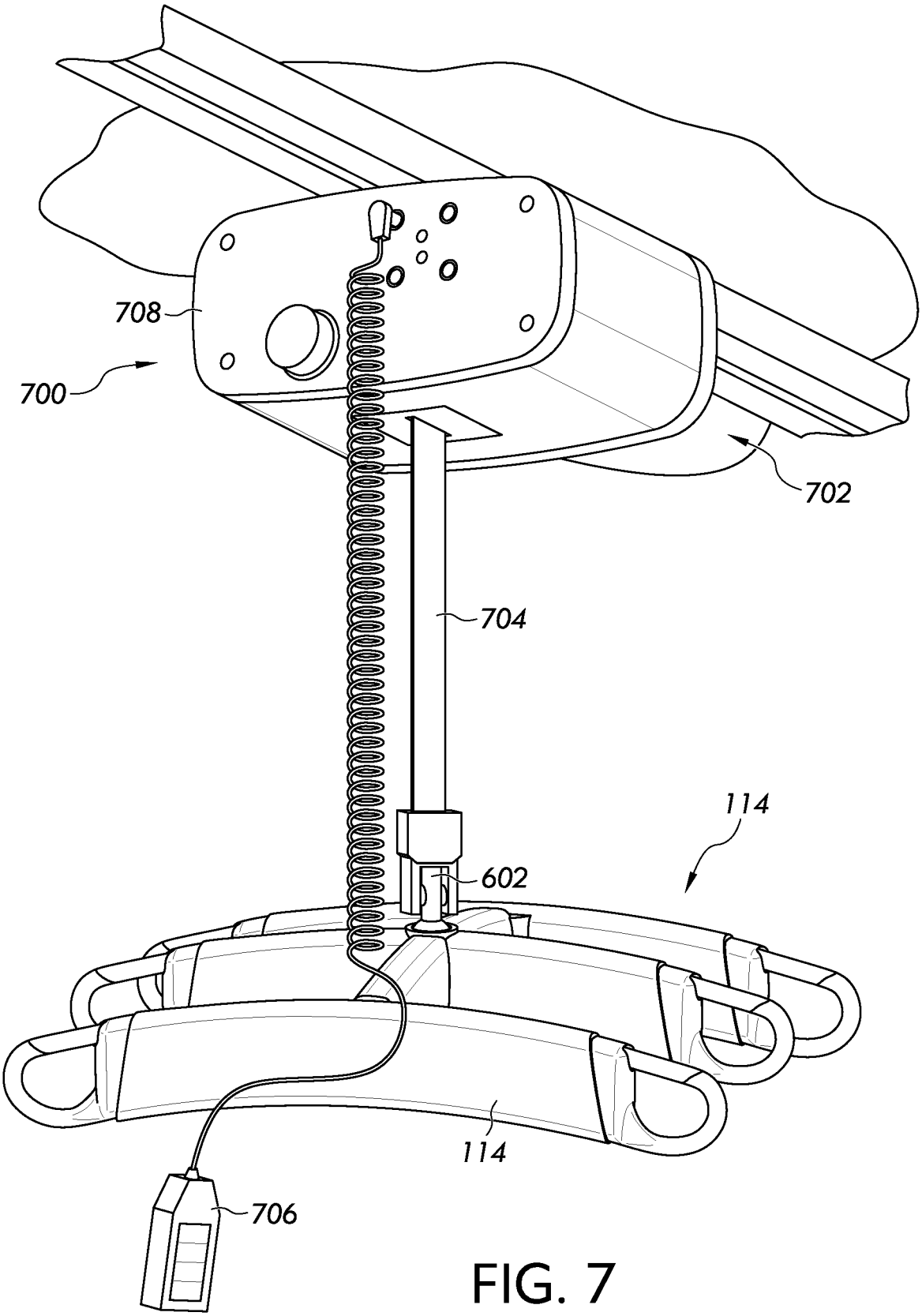
FIG. 7 schematically depicts a lift mechanism according to one or more embodiments shown and described herein.

In some embodiments, the lift mechanism 106 may be a lift assembly, such as a mobile lift assembly or, alternatively, the overhead lift assembly 700 depicted in FIG. 7. The overhead lift assembly 700 may include a lift 702, a strap 704 configured to be extended and retracted by the lift 702, and a control system including an input device 706 configured to control operations of the lift 702. In embodiments, the sling bar assembly 114 is coupled to an end of the strap 704 through the connector 602. The lift 702 may further include a motor and a drum (not shown), each positioned within a housing 708. The drum may be coupled to a shaft of the motor and may be configured to extend and retract the strap 704 as the motor rotates the drum in response to a user providing an input to the control system via an input device 706. Various lift assemblies may be employed, including those described in U.S. Patent Application Publication No. 2015/0216753, entitled "Person Lift System", which is hereby incorporated by reference in its entirety. Suitable commercially available lift assemblies include, by way of example and not limitation, lift systems available under the trade names GOLVO®, LIKO®, SABINA®, VIKING®, UNO™, LIKOGUARD™ LIKORALL™, and MULTI-RALL™, from Liko, HILL-ROM®, or Hill-Rom Services, Inc. (Batesville, Ind.).

In practice, a user, such as a caregiver, positions the sling 102 between a subject to be lifted and a surface upon which the subject is disposed, such as a bed or other subject support. In some embodiments, the sling 102 may be positioned on the subject support surface before the subject is positioned thereon. For example, the sling 102 may be positioned on the mattress before the subject is transferred to the mattress. Alternatively, the sling 102 may be slid under the subject, between the subject and the surface on which the subject is positioned. Next, each clamp is repositioned in a closed position to engage the clamp with the visual indicator in order to selectively couple the clamp to the visual indicator, as shown in FIGS. 2 and 3. In some embodiments, each clamp includes a visual indicator that corresponds to the visual indicator on the sling with which the clamp should be engaged which may enable a user to quickly and correctly identify locations for engaging the clamps, thereby preventing improper use or confusion for the user. In embodiments in which the clamps include locks, the user may lock each clamp to ensure that the clamps are not inadvertently repositioned into an open position.

In some embodiments, the user then couples each clamp to a lift mechanism by looping the strap of each clamp over the hooks of the sling bar assembly. However, in other embodiments, the clamps may already be coupled to the sling bar assembly through the straps, such as is depicted in FIG. 1. The user may then activate the lift mechanism to lift the subject.

Based on the foregoing, it should be understood that various embodiments provide for subject support systems that include a sling in the form of a sheet having one or more visual indicators and one or more clamps that may be selectively coupled to the visual indicator(s) to couple the sling to a lift mechanism. Such embodiments may provide additional comfort and support to subjects as compared to conventional subject support systems, while improving ease of manufacturing and enabling a caregiver or other user to easily determine how the clamp(s) should be coupled to the sling.

Embodiments can be described with reference to the following numbered clauses, with preferred features laid out in the dependent clauses:

1. A subject support system includes a sling having an outer perimeter extending around and defining a support region of the sling and a visual indicator positioned along the outer perimeter of the sling, a clamp selectively coupled to the visual indicator and a strap coupled to the clamp and configured to couple the clamp to a lift mechanism. The clamp is repositionable between a closed position, in which the clamp is engaged with the visual indicator, and an open position, in which the clamp is disengaged from the visual indicator.

2. A subject support system including a sling including an outer perimeter extending around and defining a subject support surface of the sling, the sling having a first end and a second end positioned opposite the first end, a first pair of clamps each selectively coupled to the first end of the sling along the outer perimeter of the sling, a second pair of clamps each selectively coupled to the second end of the sling along the outer perimeter of the sling, and a plurality of straps coupled to one of the clamps and configured to couple the clamps to a lift mechanism.

3. The subject support system of any preceding clause, wherein the clamp applies a force to the visual indicator in a direction that is transverse to a plane of the sling when the clamp is in the closed position.

4. The subject support system of any preceding clause, wherein the clamp comprises a base portion and a clamp portion pivotally coupled to the base portion, wherein the clamp portion engages the visual indicator when the clamp is in the closed position.

5. The subject support system of any preceding clause, wherein the clamp further comprises a visual indicator that corresponds to the visual indicator of the sling.

6. The subject support system of any preceding clause, further comprising a sling bar assembly, wherein the strap is removably coupled to the sling bar assembly to couple the clamp to the lift mechanism.

7. The subject support system of any preceding clause, wherein a first group of the plurality of straps has a length that is different than a length of a second group of the plurality of straps.

8. The subject support system of any preceding clause, wherein the strap that is configured to couple the second clamp to the lift mechanism has a length that is different than a length of the strap that is configured to couple the first clamp to the lift mechanism.

9. The subject support system of any preceding clause, further comprising a third pair of clamps each selectively coupled to the sling along the outer perimeter of the sling between the first pair of clamps and the second pair of clamps.

10. The subject support system of any preceding clause, wherein the sling comprises a first pair of visual indicators along the outer perimeter of the sling, each of the first pair of visual indicators being indicative of a location at which one of the first pair of clamps is coupled to the first end of the sling.

11. The subject support system of any preceding clause, wherein each of the first pair of clamps comprise a visual indicator corresponding to the first pair of visual indicators.

12. The subject support system of any preceding clause, wherein the sling comprises a second pair of visual indicators along the outer perimeter of the sling, each of the second pair of visual indicators being indicative of a location at which one of the second pair of clamps is to be coupled to the second end of the sling.

13. The subject support system of any preceding clause, wherein each of the second pair of clamps comprise a visual indicator corresponding to the second pair of visual indicators.

14. The subject support system of any preceding clause, wherein the first clamp comprises a visual indicator that corresponds to the first visual indicator of the sling and the second clamp comprises a visual indicator that corresponds to the second visual indicator of the sling.

15. A method of lifting a subject includes: positioning a sling according to any preceding clause between the subject and a surface upon which the subject is disposed; engaging the clamp with the visual indicator to selectively couple the clamp to the visual indicator, wherein the clamp is coupled to a strap configured to couple the clamp to a lift mechanism; and activating the lift mechanism to lift the subject.

16. The method of clause 15, wherein the visual indicator is a first visual indicator, the clamp is a first clamp, and the sling comprises a second visual indicator, the method further comprising engaging a second clamp with the second visual indicator to selectively couple the second clamp to the second visual indicator, wherein the second clamp is coupled to a strap configured to couple the second clamp to the lift mechanism.

17. The method of clause 15 or 16, further comprising coupling the strap that is configured to couple the clamp to the lift mechanism to a sling bar assembly that is coupled to the lift mechanism.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A subject support system comprising:

a sling, comprising:

an outer perimeter extending around and defining a support region of the sling;

a first side;

a second side positioned opposite the first side;

a plurality of visual indicators including:

a first set of visual indicators positioned on the first side along the outer perimeter of the sling, each visual indicator of the first set of visual indicators displaying a first visual effect and configured to identify a particular location on the first side for clamping to the sling to lift the subject in at least one determined lift position; and a second set of visual indicators positioned on the second side along the outer perimeter of the sling, each visual indicator of the second set of visual indicators displaying a second visual effect different from the first visual effect and configured to identify a particular location on the second side for clamping to the sling to lift the subject in the at least one determined lift position;

a first set of clamps, each clamp of the first set of clamps selectively coupleable to one visual indicator of the first set of visual indicators;

a second set of clamps, each clamp of the second set of clamps selectively coupleable to one visual indicator of the second set of visual indicators;

a plurality of straps, each of the plurality of straps coupled to a corresponding clamp of the first set of clamps and the second set of clamps, each of the plurality of straps configured to couple its respective clamp to a lift mechanism; and wherein each visual indicator of the first set of visual indicators and second set of visual indicators comprises a coating that increases friction when a corresponding clamp of the first set of clamps or the second set of clamps is engaged with the visual indicator in the closed position.

2. The subject support system of claim 1, wherein each clamp of the first set of clamps and the second set of clamps applies a force to a corresponding visual indicator of the first set of visual indicators and the second set of visual indicators, respectively, in a direction that is transverse to a plane of the sling when the clamp is in the closed position.

3. The subject support system of claim 2, wherein each clamp of the first set of clamps and the second set of clamps comprises a base portion and a clamp portion pivotally coupled to the base portion, wherein each clamp portion engages one visual indicator of the first set of visual indicators and the second set of visual indicators, respectively, when the clamp is in the closed position.

4. The subject support system of claim 1, wherein each of the clamps of the first and second set of clamps further comprises a visual effect that corresponds to the first and second set of visual indicators of the sling, respectively.

5. The subject support system of claim 1, further comprising a sling bar assembly, wherein each strap of the plurality of straps is removably coupleable to the sling bar assembly to couple its respective clamp to the lift mechanism.

6. The subject support system of claim 1, wherein the first visual effect and the second visual effect are perceptible to identify the particular locations at the first side and the second side, respectively, for clamping to the sling.

7. The subject support system of claim 1, wherein the first visual effect and the second visual effect are different than the support region.

8. A subject support system comprising:

a sling, comprising:

an outer perimeter extending around and defining a subject support surface of the sling;

a first end;

a second end positioned opposite the first end; and a plurality of visual indicators including:

a first pair of visual indicators positioned at the first end along the outer perimeter of the sling, each visual indicator of the first pair of visual indicators displaying a first visual effect and configured to identify a particular location at the first end for clamping to the sling to lift the subject in at least one determined lift position; and a second pair of visual indicators positioned at the second end along the outer perimeter of the sling, each visual indicator of the second pair of visual indicators displaying a second visual effect different from the first visual effect and identifying a particular location at the second end for clamping to the sling to lift the subject in the at least one determined lift position;

a first pair of clamps, each clamp of the first pair of clamps selectively coupleable to a visual indicator of the first pair of visual indicators;

a second pair of clamps, each clamp of the second pair of clamps selectively coupleable to a visual indicator of the second pair of visual indicators;

a plurality of straps comprising a strap coupled to each clamp of the first pair of clamps and each clamp of the second pair of clamps, each strap of the plurality of straps configured to couple its respective clamp to a lift mechanism; and wherein each visual indicator of the plurality of visual indicators comprises a coating that increases friction when each clamp of the first pair of clamps is coupled to its respective visual indicator of the first pair of visual indicators and each clamp of the second pair of clamps is coupled to its respective visual indicator of the second pair of visual indicators.

9. The subject support system of claim 8, wherein:

the at least one determined lift position includes a sitting position; and the strap coupled to each clamp of the first pair of clamps has a length that is different than a length of the strap coupled to each clamp of the second pair of clamps.

10. The subject support system of claim 8, further comprising:

a third pair of clamps, each clamp of the third pair of clamps selectively coupleable to the sling along the outer perimeter of the sling between the first pair of clamps coupleable at the first end and the second pair of clamps coupleable at the second end.

11. The subject support system of claim 8, wherein:

each clamp of the first pair of clamps comprises a visual effect that corresponds to the first pair of visual indicators; and each clamp of the second pair of clamps comprises a visual effect that corresponds to the second pair of visual indicators.

12. The subject support system of claim 8, wherein:

the at least one determined lift position includes a horizontal position; and the strap coupled to each clamp of the first pair of clamps has a length that is substantially the same as a length of the strap coupled to each clamp of the second pair of clamps.

13. The subject support system of claim 8, wherein the first visual effect and the second visual effect are perceptible to identify the particular locations at the first end and the second end, respectively, for clamping to the sling.

14. A method of lifting a subject comprising:

positioning a sling between the subject and a surface upon which the subject is disposed, the sling comprising:

an outer perimeter extending around and defining a support region of the sling;

a first end;

a second end positioned opposite the first end; and a plurality of visual indicators including:

a first pair of visual indicators positioned at the first end along the outer perimeter of the sling, each visual indicator of the first pair of visual indicators displaying a first visual effect and identifying a particular location at the first end for clamping to the sling to lift the subject in at least one determined lift position; and a second pair of visual indicators positioned at the second end along the outer perimeter of the sling, each visual indicator of the second pair of visual indicators displaying a second visual effect different from the first visual effect and identifying a particular location at the second end for clamping to the sling to lift the subject in the at least one determined lift position;

coupling a first pair of clamps to the first pair of visual indicators and a second pair of clamps to the second pair of visual indicators to perform the at least one determined lift position, wherein each clamp of the first and second pairs of clamps is coupled to a strap configured to couple the clamp to a lift mechanism;

wherein each visual indicator of the plurality of visual indicators comprises a coating that increases friction when each clamp of the first pair of clamps is coupled to its respective visual indicator of the first pair of visual indicators and each clamp of the second pair of clamps is coupled to its respective visual indicator of the second pair of visual indicators; and activating the lift mechanism.

15. The method of claim 14, wherein each clamp of the first pair of clamps comprises a visual effect that corresponds to the first pair of visual indicators and each clamp of the second pair of clamps comprises a visual effect that corresponds to the second pair of visual indicators of the sling.

16. The method of claim 14, wherein:

the at least one determined lift position includes a sitting position; and each strap that is configured to couple the second pair of clamps to the lift mechanism has a length that is different than a length of each strap that is configured to couple the first pair of clamps to the lift mechanism.

17. The method of claim 14, wherein:

the at least one determined lift position includes a horizontal position; and each strap that is configured to couple the second pair of clamps to the lift mechanism has a length that is substantially the same as a length of each strap that is configured to couple the first pair of clamps to the lift mechanism.

* * * * *